US005415101A

United States Patent [19]

Brinkmann

[11] Patent Number: 5,415,101

[45] Date of Patent: May 16, 1995

[54] SHAPED EXPLOSIVE CHARGE, A METHOD OF BLASTING USING THE SHAPED EXPLOSIVE CHARGE AND A KIT TO MAKE IT

[75] Inventor: Joseph R. Brinkmann, Transvaal, South Africa

[73] Assignee: Jet Technologies (Proprietary) Limited, Transvaal, South Africa

[21] Appl. No.: 54,967

[22] Filed: May 3, 1993

[30] Foreign Application Priority Data

May 4, 1992 [ZA] South Africa ..... 92/3211

[51] Int. Cl.[6] ..... F42B 1/02

[52] U.S. Cl. ..... 102/307

[58] Field of Search ..... 102/307

[56] References Cited

U.S. PATENT DOCUMENTS

| | | | |
|---|---|---|---|
| 3,885,929 | 12/1974 | Ridgeway | 102/24 HC |
| 4,069,760 | 1/1978 | Eckels | 102/23 |
| 4,109,576 | 8/1978 | Eckels | 102/24 HC |
| 4,126,092 | 11/1978 | Cross | 102/24 HC |
| 4,151,798 | 5/1979 | Ridgeway | 102/24 HC |
| 4,297,946 | 11/1981 | Paton et al. | 102/309 |
| 4,359,943 | 11/1982 | Majerus | 102/309 |
| 4,387,773 | 6/1983 | McPhee | 175/4.6 |
| 4,418,622 | 12/1983 | Foster et al. | 102/307 |
| 4,418,662 | 12/1983 | Engler et al. | 123/198 D |
| 4,430,939 | 2/1984 | Harrold | 102/307 |
| 4,441,428 | 4/1984 | Wilson | 102/307 |
| 4,450,768 | 5/1984 | Bell | 102/307 |
| 4,466,353 | 8/1984 | Grace | 102/307 |
| 4,493,260 | 1/1985 | Foster | 102/307 |
| 4,627,353 | 12/1986 | Chawla | 102/307 |
| 4,643,097 | 2/1987 | Chawla et al. | 102/306 |
| 4,815,384 | 3/1989 | Ringel et al. | 102/307 |
| 4,955,939 | 9/1990 | Petrovsky et al. | 102/476 |
| 4,982,665 | 1/1991 | Sewell et al. | 102/306 |
| 5,067,409 | 11/1991 | Schildknecht et al. | 102/476 |
| 5,151,558 | 9/1992 | Rudolf et al. | 102/476 |
| 5,170,004 | 12/1992 | Garrison et al. | 89/1.14 |
| 5,175,391 | 12/1992 | Walters et al. | 102/307 |

*Primary Examiner*—Peter A. Nelson

*Attorney, Agent, or Firm*—Lowe, Price, LeBlanc & Becker

[57] ABSTRACT

A shaped explosive charge 10 and a method of blasting a solid body 6 using the shaped explosive charge are provided. The explosive charge 10 comprises a first end 8 and a second end 9 and a mass of explosive material 14 towards the first end 8 thereof. It also comprises a housing 12 with a partition 32 and a peripheral skirt 18 which create a standoff space 20 between the mass of explosive material 14 and a surface of the solid body 6 exploded. In use, the explosive charge 10 is placed in a detonation position near, on or within the solid body 6 with the second end 9 thereof facing a surface of the body 6, and the mass of explosive material 14 is then detonated.

12 Claims, 1 Drawing Sheet

SHAPED EXPLOSIVE CHARGE, A METHOD OF BLASTING USING THE SHAPED EXPLOSIVE CHARGE AND A KIT TO MAKE IT

BACKGROUND OF THE INVENTION

This invention relates to a shaped explosive charge, a method of blasting using the shaped explosive charge and to a kit to make the shaped explosive charge.

Explosives are used widely in the mining industry to wrest ore from the ground. They are used also in other applications, however, to fracture solid masses, for example rocks, boulders and concrete. In mining, ore is extracted from a general body of rock by blasting the rock. This is known as primary rock blasting. The result of this primary rock blasting is a number of pieces of rock of varying sizes. Generally, at least 1–5% of this rock is oversized in that it cannot be handled or processed by standard equipment or techniques. The oversized rock must then be subjected to one of three further steps before it is rendered manageable. These steps are collectively known as secondary breakage.

In the first of these steps an amount of explosive is placed at a point on the periphery of the rock mass. It is often fixed to the rock mass or confined by surrounding it with sealer to form a "mudcap". The explosive is then detonated to further reduce the rock mass into pieces that are easier to handle. The main disadvantages of this method are that it is an inefficient use of energy and is violent in terms of airblast and flyrock.

The second method of breaking down oversized pieces of rock is to bore a channel in the rock mass and then to place explosives in the hole and then to explode them. This method, however, is labour intensive as each targeted rock mass has to be worked on and expensive and bulky machinery is required to bore the holes, and it is time consuming. This method of blasting can also produce dangerous flyrock.

The last method is that of mechanical breakage where the oversized pieces of rock are broken by drop weights and other mechanical means to more manageable pieces. The disadvantages of this method are that bulky and expensive machinery is needed to break the oversized rock one at a time, and the machinery is subject to large amounts of stress and wear and tear and is thus also expensive to maintain.

SUMMARY OF THE INVENTION

According to the invention an explosive charge has a first end and a second end and comprises a mass of explosive material towards the first end thereof and means towards the second end thereof for creating a standoff space.

Standoff space is defined herein to mean the space between the mass of explosive material in the explosive charge and the surface of a solid body to be exploded by the explosive charge when it is placed in a detonation position near, on, or in the solid body.

Preferably, a cavity is defined in the mass of explosive material at a position adjacent the second end of the explosive charge.

The cavity is preferably substantially spherical, hemispherical, parabolic, hyperparabolic or ellipsoid with a maximum depth which is substantially equal to one half of its diameter.

The height of the standoff space is generally between 0 and 1 times, and more preferably 0.5 times, the diameter of the cavity.

The mass of explosive material preferably tapers towards the first end of the explosive charge. The angle of taper is preferably between 10 and 45 degrees.

The length of the mass of explosive material between the first end and the second end of the explosive charge is substantially equal to the diameter of the cavity.

The general shape of the periphery of the mass of explosive material adjacent the second end of the explosive charge is preferably circular with a diameter which is as large as possible per unit mass of explosive material given the angle of taper.

The explosive charge preferably comprises an initiation site, partially or wholly within the mass of explosive material or adjacent to it, for accommodating an initiating means.

The initiation site is preferably located towards the first end of the explosive charge.

The initiation site, the mass of explosive material and the cavity preferably have a common axis of symmetry.

The explosive charge preferably also includes a housing within which the mass of explosive material is disposed, the housing defining the first and second ends of the explosive charge.

The explosive charge preferably includes a partition which separates the mass of explosive material from the cavity. The partition preferably has a thickness of about 1 mm or less. The partition is preferably made from a material which, on ignition of the explosive charge, disintegrates into fine particles or powder. Suitable materials include certain plastics, paper, metal sheet or foil and sintered coatings.

Preferably, the explosive charge is generally rotationally symmetrical, and may be, for example, right circular cylindrical, hemispherical, conical or frusto-conical or combinations thereof. Most preferably the explosive device of the invention is in the form of a conical frustrum.

According to another aspect of the invention a method of blasting a solid body comprises the steps of: placing an explosive charge of the invention in a detonation position near, on or within the solid body with the second end of the explosive charge facing a surface of the body to be blasted; and detonating the mass of explosive material.

According to another aspect of the invention a method of blasting a solid body comprises the steps of: placing a mass of explosive material in a detonation position near, on or within the solid body; placing a spacer between the mass of explosive material and a surface of the solid body to be blasted; and detonating the mass of explosive material.

According to yet another aspect of the invention a cartridge for an explosive charge comprises a housing having a first end and a second end, and a partition within the housing to define a first area within the housing within which a mass of explosive material can be received and a second area within the housing which creates a cavity in the body of explosive material and a standoff space. The kit may also contain a spacer for setting the standoff distance.

According to another aspect of the invention a kit for an explosive charge comprises a cartridge of the invention and a mass of explosive material which may be charged into the cartridge.

DESCRIPTION OF PREFERRED EMBODIMENTS

Figure 1:
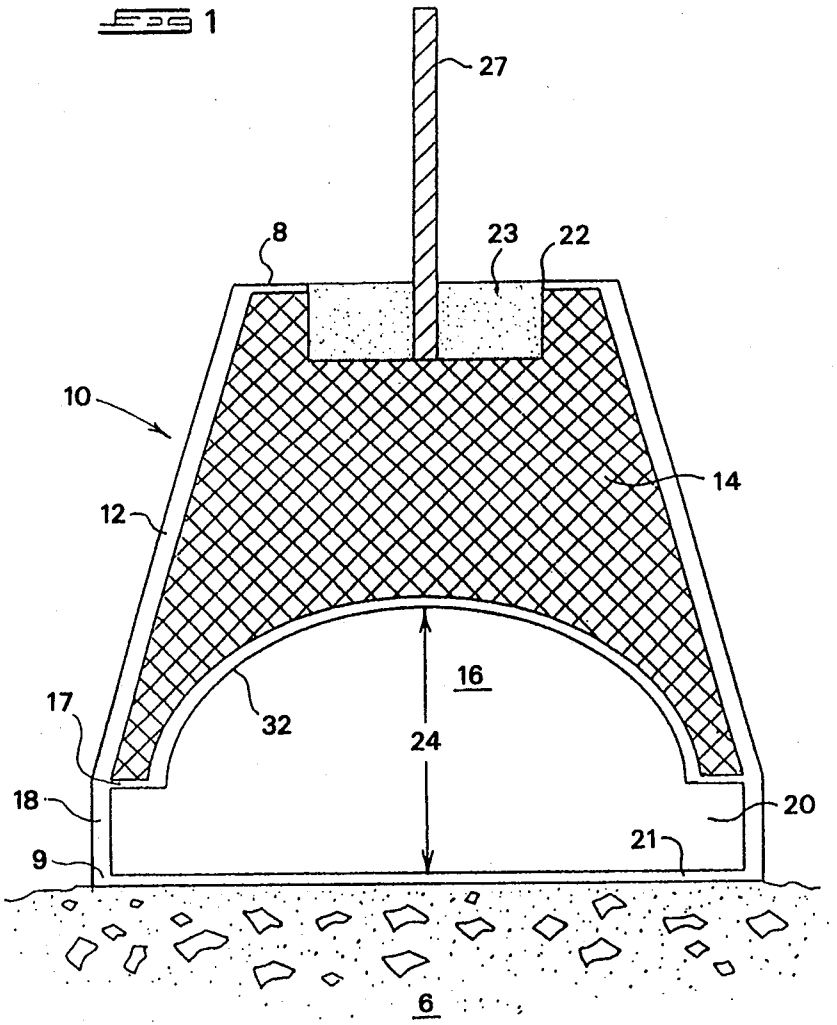
FIG. 1 is a schematic sectional side view through an explosive charge of the invention with a cavity defined in one end thereof.

The rotationally symmetric shaped explosive charge 10 illustrated in FIG. 1 has a first end 8 and a second end 9, and comprises a housing 12 which defines the first and second ends 8 and 9, a mass of explosive material 14 disposed towards the first end 8 of the explosive charge 10, and a peripheral skirt 18, which is an extension of the housing 12 and which creates part of a standoff space 20 between the mass of explosive material 14 and the surface of a solid body 6 to be exploded by the explosive charge 10.

A cavity 16 is defined in the mass of explosive material 14 at a position adjacent the second end 9 of the explosive charge 10 by a partition 32. The interior of the cavity also forms part of the standoff space 20. The shape of the cavity 16 is hemispherical. It may, however, assume another rotationally symmetrical shape, such as a spherical sector, cone, conical-frustrum, conical section, or even a non-circular shape such as a pyramid. The depth of the cavity 16 is substantially equal to half its diameter. The general shape of the periphery 17 of the mass of explosive material 14 adjacent the second end 9 of the explosive charge 10 is circular, and the diameter of the cavity is substantially equal to that of the periphery 17. A cavity with a smaller diameter is also acceptable, although this is detrimental to the efficacy of the explosive charge.

When the explosive charge 10 is placed in a detonation position near, on or within the solid body 6, with its second end 9 facing the surface of the solid body 6, the height of the standoff space 20 is relatively small. The height 24 of the standoff space 20, of course, depends in part on the diameter of the cavity 16. It is generally between 0 and 1 times the diameter of the cavity 16. Typically, however, it is a quarter or one half this diameter. The length of the mass of explosive material 14 from the periphery 17 to the end 8 is substantially equal to the diameter of the cavity 16.

It will be understood that the standoff space 20 is empty. When it is required to use the explosive charge 10 of the invention underwater or in wet or muddy conditions, the end 9 may be closed by a cap 21 which is continuous with the housing 12.

The housing 12 is made of materials that will minimize the generation of harmful, high velocity fragments or shrapnel when the explosive material is detonated. Suitable materials include cast iron; sintered metals and ceramics; paper; cardboard; papier-mache; plastics; rubber; laminates; and fibres. The housing 12 tapers towards the first end 8 of the explosive device 10. The angle of taper is typically between 10 and 45 degrees. This ensures that the mass of explosive material 14 tapers in a corresponding way so that it is narrower at the end 8 than at the end 9.

The diameter at the periphery 17 of the mass of explosive material 14 is as large as possible per unit of explosive material, given the angle of taper. In the explosive device 10, the diameter of the periphery 17 is slightly larger than that of the cavity 16.

An initiation site 22 for accommodating a detonator or other initiating device is defined in the end 8 of the explosive charge 10. A primer 23 fills the initiation site 22. The primer 23 may be omitted, depending on the type of explosive material 14 used and depending on the strength of the initiating device used. In the explosive charge 10, a short length of detonating cord 27 is firmly built into the initiation site 22. The initiation site 22, the mass of explosive material 14 and the cavity 16 have a common axis of symmetry.

Figure 2:
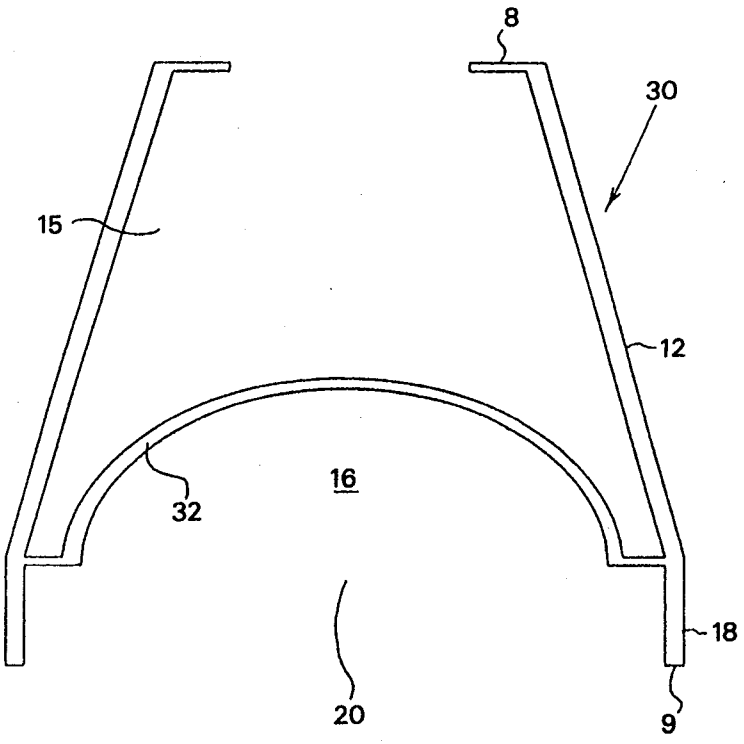
FIG. 2 is a schematic sectional side view through a cartridge for an explosive charge of the invention which does not contain explosive material.

The explosive cartridge 30 illustrated in FIG. 2 contains no explosive material or primer. It has a housing 12, which defines a first end 8 and a second end 9, a peripheral skirt 18 and a partition 32. The partition 32 defines, within the housing 12, a first area 15 and a second area 20. A mass of explosive material can be received in the first area 15 and the second area 20 creates a standoff space when explosive material is so received. The standoff space 20 then also includes a cavity 16 which is defined in the mass of explosive material.

The partition 32 of the explosive charge 10 and the explosive cartridge 30 is made of a thin layer of a suitable material of such a nature that on ignition of the explosive device it disintegrates into fine particles or powder. Suitable materials include certain types of plastics, paper, metal sheet or foil and even sintered coatings. This partition 32 facilitates the charging of the mass of explosive material into the housing 12. When the area 15 is filled with explosive material, the partition 32 also defines and maintains the shape of a cavity in the explosive material.

The explosive cartridge 30 may be supplied in kit form, together with a mass of explosive material and a spacer to set the standoff space.

The mass of explosive material in either the charge 10 or the cartridge 30 may comprise one or more different types of explosive materials or compositions. The preferred explosive compositions have a high velocity of detonation, typically greater than 5000 meters per second, but other compositions with a lower velocity of detonation, such as slurries and emulsions, may also be used. If two or more explosive compositions having varying velocities of detonation are charged into an explosive charge 10 or a cartridge 30, the compositions are arranged in layers with that having the highest velocity of detonation being placed closest to the standoff space 20 and thus to the surface to be blasted.

When the body of explosive material is detonated, the detonation wave is directional; it proceeds in the direction defined by the longitudinal axis of the explosive charge 10 or cartridge 30. Thus, the shape of the mass of explosive material 14 in the explosive charge 10, and the shape of the area 15 in the cartridge 30, are crucial. In the case of the charge 10, the detonation wave proceeds from an initiator or detonator inserted into the initiation site 22 towards the cavity 16.

The presence of the cavity 16 is also crucial. It serves to focus the flow of detonation gases, and thereby to concentrate the energy of the explosion, in a gas stream which impacts the solid body to be blasted, within which or against which the explosive charge 10 or the filled cartridge 30 has been placed.

In use, the explosive charge 10 or a filled cartridge 30 is placed in a detonation position on, near or within a solid body to be exploded. In FIG. 1 it can be seen that the explosive charge 10 is placed on the solid body 6 with its second end 9 facing a surface of the body to be blasted.

The relative dispositions of the initiation site 22, the mass of explosive material 14 and the cavity 16 are also crucial. They serve to direct the directional detonation wave in the explosive mass and thereby to concentrate the useful energy of the explosion. The manner in which this concentration occurs, however, depends not only on the shape of the explosive material 14 or the area 15 and the presence of the cavity 16, but also on the profile of the cavity 16. If the interface between the body of explosive material 14 and cavity 16 is hemispherical as shown in FIGS. 1 and 2, the concentrating effect is greater than if it were flat. It also depends on the type of explosive used, the standoff distance, and the diameter of the cavity. When the focussed, high velocity stream of detonation product gases strike the solid mass that is to be blasted, fracturing and splitting of the mass occurs on impact.

The presence of the standoff distance is another crucial aspect of the invention. If the standoff distance were absent and the explosive material was in direct contact with the surface of the solid body to be blasted, or if the standoff distance were substantially greater than the recommended value, the fracturing and splitting effect would be much reduced.

The fracturing and splitting effect can be further promoted on very large solid bodies by using a plurality of explosive charges of the invention, which are either detonated simultaneously or sequentially. Additional splitting and fracturing may be attained by placing the plurality of explosive charges in specific geometric patterns on the body to be blasted, such as in straight rows, in rows that cross one another, or in grid patterns defining squares and rectangles and other geometric shapes. The breaking and fracturing action of a plurality of charges can also be enhanced by placing charges on opposite sides of a large solid body to be blasted and detonating these charges simultaneously.

The solid bodies which may be blasted using the explosive charges and filled cartridges and the method of the invention include rock, boulders, concrete, masonry, and kiln and other process deposits or scale. They can also be used to punch holes in metallic and other solid bodies that are not easily shattered into pieces, such as timber, steel cables, steel bars, wire ropes.

The explosive devices of the invention break rock and other solid bodies more efficiently than the traditional lay-on and "mudcap" charges, and do not require a hole to be drilled in the rock or solid body to place the explosive charge in.

I claim:

1. An explosive charge having a first end and a second end and a circular cross-sectional area and comprising a mass of explosive material towards the first end thereof and a standoff space towards the second end thereof, the standoff space including a cavity which is defined in the mass of explosive material at a position adjacent the second end of the explosive charge, the standoff space having a height which is between one-quarter and one-half a diameter of the cavity adjacent the second end of the charge.

2. An explosive charge according to claim 1, wherein the mass of explosive material has a height which is substantially equal to the diameter of the cavity adjacent the second end of the charge.

3. An explosive charge according to claim 2, wherein the cavity is substantially spherical, hemispherical, parabolic, hyperbolic or ellipsoid, with a maximum depth which is substantially equal to one half its diameter nearest the second end of the charge.

4. An explosive charge according to claim 1, wherein the mass of explosive material tapers towards the first end of the charge.

5. An explosive charge according to claim 1, which comprises an initiation site, at least partially within the mass of explosive material or adjacent thereto, for accommodating an initiating means.

6. An explosive charge according to claim 5, wherein the initiation site is located towards the first end of the explosive charge, and wherein the initiation site, the mass of explosive material and the cavity have a common axis of symmetry.

7. An explosive charge according to claim 1, further comprising a housing within which the mass of explosive material is disposed, the housing defining the first and second ends of the explosive charge.

8. An explosive charge according to claim 1, further comprising a partition separating the mass of explosive material from the cavity.

9. An explosive charge according to claim 1 which is generally rotationally symmetric.

10. A method of blasting a solid body, using an explosive charge having a first end and a second end and a circular cross-sectional area and including a mass of explosive material towards the first end thereof and a standoff space towards the second end thereof, the standoff space including a cavity which is defined in the mass of explosive material at a position adjacent the second end of the explosive charge, the standoff space having a height which is between one-quarter and one-half a diameter of the cavity adjacent the second end of the charge, the method comprising the steps of placing the explosive charge in a detonation position near, on or within the solid body with the second end of the explosive charge facing a surface of the body to be blasted; and detonating the mass of explosive material.

11. A cartridge for an explosive charge comprising a housing having a first end and a second end and a circular cross-sectional area, and a partition within the housing for defining a first area within the housing within which a mass of explosive material can be received and a second area within the housing which creates a standoff space when the explosive material is so received, said standoff space including a cavity defined in the mass of explosive material adjacent the second end of the housing, and the standoff space having a height which is between one-quarter and one-half a diameter of the cavity adjacent the second end of the charge.

12. A kit for an explosive charge comprising a cartridge of claim 11 and a mass of explosive material.

* * * * *